US006796293B2

(12) United States Patent
Bayerle et al.

(10) Patent No.: US 6,796,293 B2
(45) Date of Patent: Sep. 28, 2004

(54) METHOD FOR STARTING AN INTERNAL COMBUSTION ENGINE AND STARTER DEVICE FOR AN INTERNAL COMBUSTION ENGINE

(75) Inventors: Klaus Bayerle, Obertraubling (DE); Gerhard Haft, Obermotzing (DE); Gregor Probst, Landshut (DE); Hong Zhang, Tegernheim (DE)

(73) Assignee: Siemens Aktiengesellschaft, München (DE)

( * ) Notice: Subject to any disclaimer, the term of this patent is extended or adjusted under 35 U.S.C. 154(b) by 49 days.

(21) Appl. No.: 10/240,610

(22) PCT Filed: Feb. 19, 2001

(86) PCT No.: PCT/DE01/00645

§ 371 (c)(1),
(2), (4) Date: Sep. 30, 2002

(87) PCT Pub. No.: WO01/75300

PCT Pub. Date: Oct. 11, 2001

(65) Prior Publication Data

US 2003/0150430 A1 Aug. 14, 2003

(51) Int. Cl.[7] ..... F02N 11/08; F02D 41/06
(52) U.S. Cl. ..... 123/491; 123/179.3
(58) Field of Search ..... 123/179.3, 179.16, 123/339.14, 339.24, 491

(56) References Cited

U.S. PATENT DOCUMENTS 4,582,031 A * 4/1986 Janetzke et al. ..... 123/339.24
4,739,741 A * 4/1988 Iwata et al. ..... 123/491
6,032,632 A * 3/2000 Bolenz et al. ..... 123/179.3
6,202,614 B1 * 3/2001 Grob et al. ..... 123/179.3
6,240,890 B1 * 6/2001 Abthoff et al. ..... 123/179.3
6,286,470 B1 * 9/2001 Riksen et al. ..... 123/179.3

FOREIGN PATENT DOCUMENTS

| | | | |
|---|---|---|---|
| DE | 20 06 420 | 2/1970 | ..... F02N/5/02 |
| DE | 25 26 551 A1 | 6/1975 | ..... F02N/17/00 |
| DE | 36 35 295 A1 | 10/1986 | ..... F02D/41/06 |
| DE | 197 05 610 A1 | 2/1997 | ..... F02N/17/00 |
| DE | 197 41 294 A1 | 9/1997 | ..... F02N/9/02 |
| DE | 198 52 085 C1 | 11/1998 | ..... F02N/15/00 |
| EP | 0 820 559 B1 | 4/1995 | |
| EP | 1 008 483 A2 | 12/1998 | |
| JP | 8-326584 * | 12/1996 | |

OTHER PUBLICATIONS

Patent Abstracts of Japan 2000184509, Controller of Hybrid Vehicle, Fukuchi Hironao, Dec. 18, 1998.

* cited by examiner

*Primary Examiner*—Tony M. Argenbright
(74) *Attorney, Agent, or Firm*—David M. Thimmig; Mayer, Brown, Rowe & Maw LLP

(57) ABSTRACT

A method and device for starting an internal combustion engine in a manner which reduces the emissions occurring during starting. The method and device involving setting the throttle valve in an intake duct, accelerating the engine via a crank shaft starter alternator to a desired rotational speed, determining the suction-pipe pressure in the intake duct downstream of the throttle valve, and enabling fuel injection when the suction-pipe pressure undershoots a predetermined threshold value.

10 Claims, 3 Drawing Sheets

METHOD FOR STARTING AN INTERNAL COMBUSTION ENGINE AND STARTER DEVICE FOR AN INTERNAL COMBUSTION ENGINE

BACKGROUND OF THE INVENTION

The invention relates to a method for starting an internal combustion engine, and to a starting device for an internal combustion engine, When an internal combustion engine is started, in conventional systems the internal combustion engine is rotated with the aid of a starter to a rotational speed of approximately 200 rev/min. On account of this low rotational speed, the suction-pipe pressure decreases only slowly, because the mass air flow sucked in by the internal combustion engine is very small. The fuel injected into the intake pipe can evaporate only inadequately at low intake-pipe temperatures (cold internal combustion engine) and at the high suction-pipe pressures, thus leading to poor mixture preparation. The result of this poor mixture preparation is that, during cold starting, large fuel quantities have to be injected in order to make it possible to start the internal combustion engine. The large fuel quantity, along with its poor propagation, is the main cause of the high pollutant emissions during cold starting. Since, in conventional systems, the starting emissions cannot even be treated subsequently because the exhaust gas catalytic converter has not yet reached its operating temperature, they make a decisive contribution to the overall emissions of a driving cycle. DE 198 52 085 C1 discloses a starting device for an internal combustion engine and a method for starting an internal combustion engine. To lower the exhaust-gas emissions, it is proposed to use two starters for starting the internal combustion engine, a first starter being activated at the commencement of the starting operation, which is deactivated after the internal combustion engine has reached a defined rotational speed, and a second starter being activated.

The second starter subsequently drives the internal combustion engine further to a defined desired rotational speed, after which, when the desired rotational speed is reached, fuel is injected for the first time for subsequent combustion. The first starter, also designated as a breakaway starter, in this case accelerates the internal combustion engine to about 200 rev/min. The second starter, also designated as a run-up starter, then accelerates the internal combustion engine to revolutions of about 700 rev/min to about 1000 rev/min. Moreover, it is proposed to use as a second starter an alternator of the internal combustion engine, in a reversal of the operation of said alternator as an electric drive for the internal combustion engine, and to drive the latter further to a defined desired rotational speed at which fuel is injected for the first time for subsequent combustion.

DE 197 05 610 A1 describes a starting or drive unit for an internal combustion engine of a motor vehicle, which carries out a different starting method when the engine is cold from that when the engine is warm. In this case, the drive unit is equipped with a conventional starter and with a starter/alternator machine. To start the cold engine, the starter is activated jointly with the starter/alternator machine, and, to start the warm engine, that is to say in the start/stop mode and in the full-swing mode, the starter/alternator machine alone is activated. Thus, depending the measured temperature of the internal combustion engine, either the conventional starter or the starter/alternator machine or both together are activated. In particular, at an internal combustion engine temperature of above 30° C. to 40° C., the starter function is performed solely by the starter/alternator machine. At higher temperatures above 40° C., the starting function of the internal combustion engine is assumed solely by the wear-free starter/alternator. A cold-starting operation at temperatures below 30° is carried by means of a conventional starter which for this purpose has a high reduction.

However, the use of two starters entails an appreciable outlay in terms of construction space and costs.

SUMMARY OF THE INVENTION

The object on which the invention is based is to specify a method for starting an internal combustion engine and a starting device, by means of which the emissions occurring during the starting of the internal combustion engine, in particular during a cold start, can be reduced in a simple way.

This object is achieved by means of the features of the inventive method and by means of the features of inventive device. Further advantageous developments are claimed.

To improve the poor mixture preparation within the range of the desired idling rotational speed, the internal combustion engine is rotated up to a high rotational speed (>800 rev/min) with the aid of a crankshaft starter alternator (KSG), without fuel injection and consequently starting of the internal combustion engine having taken place. In this case, the throttle valve is set to a defined value, preferably it is kept closed. Owing to the higher mass airflow of the internal combustion engine, the suction-pipe pressure falls rapidly. Fuel injection is enabled only when the suction-pipe pressure has undershot a predetermined threshold value.

What is achieved thereby is that, at a low suction-pipe pressure, the fuel quantity quickly evaporates, thus resulting in an improvement in mixture preparation and therefore both in a reduction of pollutant emissions and a fuel saving during starting.

BRIEF DESCRIPTION OF THE DRAWINGS

Further advantageous refinements of the invention are explained in more detail below with reference to the drawing, in which.

Figure 1:
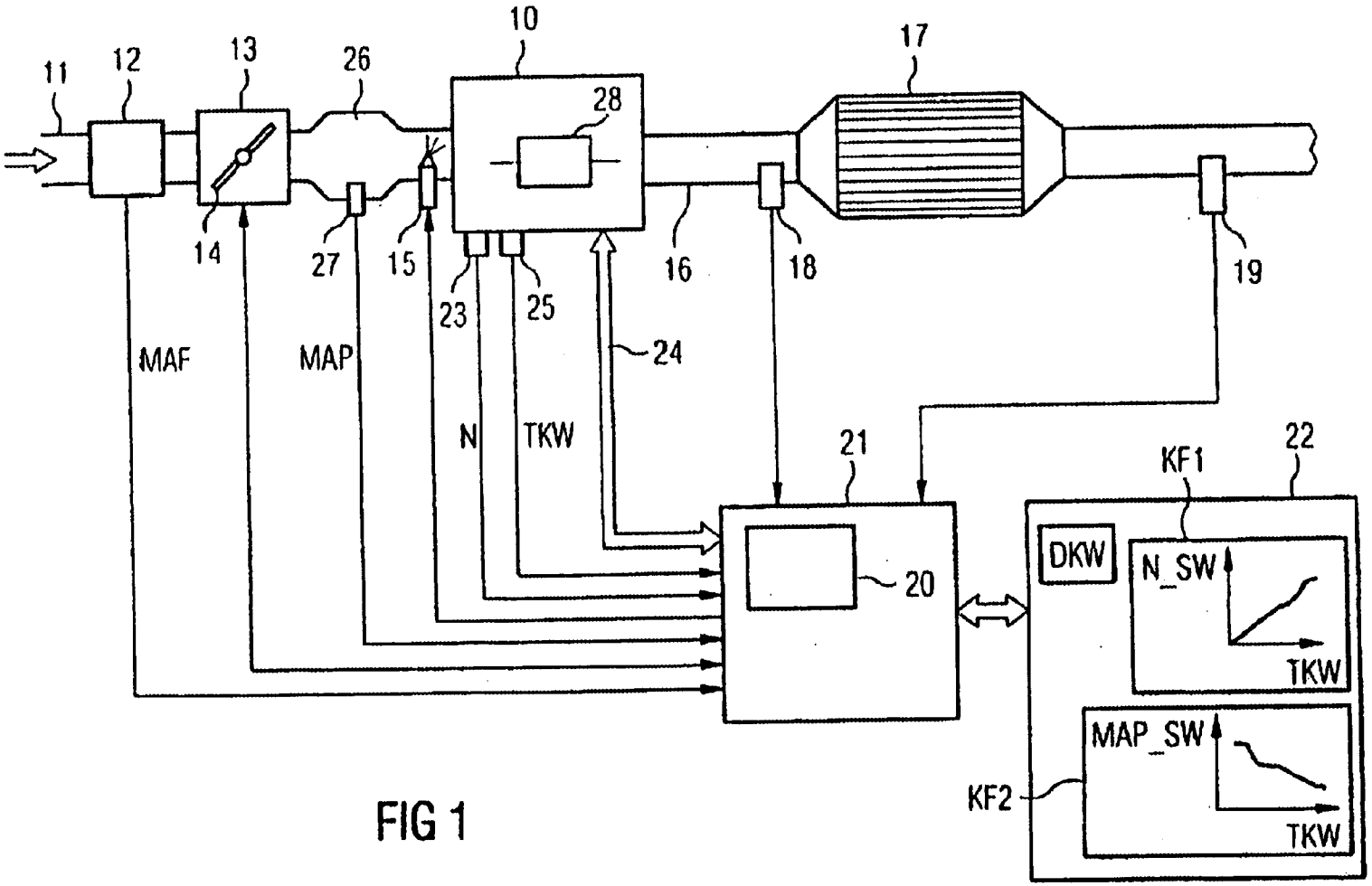
FIG. 1 shows a block diagram of an internal combustion engine with a starting device according to the invention.

It should be understood that the present invention is not limited to the preferred embodiment illustrated.

DETAILED DESCRIPTION OF THE PREFERRED EMBODIMENT

An internal combustion engine with a starting device and with an exhaust-gas retreatment system assigned to it is shown, highly simplified, in the form of a block diagram. In this case, only those components necessary for understanding the invention are illustrated. In particular, the illustration of the fuel circuit has been dispensed with.

The air necessary for combustion is supplied to the internal combustion engine 10 via an intake duct 11. In the intake duct 11 are provided in succession, as seen in the direction of flow of the intake air, an air mass meter 12, a throttle-valve block 13 and, according to the number of cylinders, a set of injection valves 15, only one of which is shown. However, the method according to the invention can also be used in a system which has only one injection valve for all the cylinders (central injection system, single-point injection system).

The throttle-valve block 13 contains a throttle valve 14 and a throttle-valve sensor, not illustrated, which transmits a signal corresponding to the opening angle of the throttle valve 14 to a control device 21. The throttle valve 14 is, for example, an electromotively activated throttle member (E-gas), the opening cross section of which can be set not only by actuation by the driver (driver's wish), but also via signals from the control device as a function of the operating range of the internal combustion engine.

The air mass meter 12 serves as a load sensor in what is known as an air mass-managed control of the internal combustion engine. Alternatively to the air mass meter 12, the load sensor used may also be a pressure sensor 27 which is arranged in a manifold 26 of the intake tract to the internal combustion engine 10 (suction-pipe pressure-managed control of the internal combustion engine).

The internal combustion engine 10 is equipped with a crankshaft starter alternator (KSG) 28. The crankshaft starter alternator 28 assumes, on the one hand, the function of a conventional starter and, on the other hand, the function of a dynamo (alternator), separate from this, for charging the vehicle battery. Crankshaft starter alternators are conventionally arranged between the internal combustion engine, on the one hand, and the transmission or automatic transmission, on the other hand, coaxially to the crankshaft and connected directly or connected couplably to the latter. A crankshaft starter alternator of this type is known, for example, from VDI Berichte [VDI Reports] number 14/15, 1998, B. Hoffmann, "Elektrische Energie für 3-Liter-Auto" ["Electric energy for 3-liter cars"], pages 39 to 53.

The internal combustion engine 10 is connected on the outlet side to an exhaust-gas duct 16, in which an exhaust-gas catalytic converter 17 is arranged. This may be any desired type of exhaust-gas catalytic converter, and, in particular, a three-way catalytic converter or an NOx storage catalytic converter may be provided.

The sensor technology for exhaust-gas retreatment contains, inter alia, an exhaust-gas measurement transducer, arranged upstream of the exhaust-gas catalytic converter 17, in the form of a lambda probe 18 and an exhaust-gas measurement transducer 19 arranged downstream of the exhaust-gas catalytic converter 17. The mixture is regulated according to the desired-value instructions by means of the signal from the lambda probe 18. This function is assumed by a lambda regulation device 20, known per se, which is integrated preferably into a control device 21 controlling or regulating the operation of the internal combustion engine. Such electronic control devices 21, which, as a rule, contain one or more microprocessors and which also assume a multiplicity of further control and regulating tasks in addition to fuel injection and ignition regulation, are known per se, so that only the setup relevant in connection with the invention and the functioning of said setup are dealt with below. In particular, the control device 21 is connected to a storage device 22 which stores, inter alia, various characteristic maps and threshold values, the respective significance of which is explained in more detail by means of the description of the following figures.

The exhaust-gas measurement transducer 19 serves as a monitor probe for the lambda probe 18 arranged upstream of the exhaust-gas catalytic converter 17 and, furthermore, can be used for controlling and checking the exhaust-gas catalytic converter 17.

The rotational speed N of the internal combustion engine 10 is detected with the aid of a rotational-speed sensor 23 and the temperature of the internal combustion engine 10 is detected, via the temperature of the coolant TKW, by means of a temperature sensor 25. These signals are likewise supplied to the control device 21 for further processing, as are the output signal MAF from the air mass meter 12 or, selectively, the output signal MAP from the suction-pipe pressure sensor 27 and the signals from the two exhaust-gas measurement transducers 18, 19.

For controlling and regulating the internal combustion engine 10, the control device 21 is also connected via a data and control line 24 to further sensors and actuators which are not explicitly illustrated.

Figure 2:
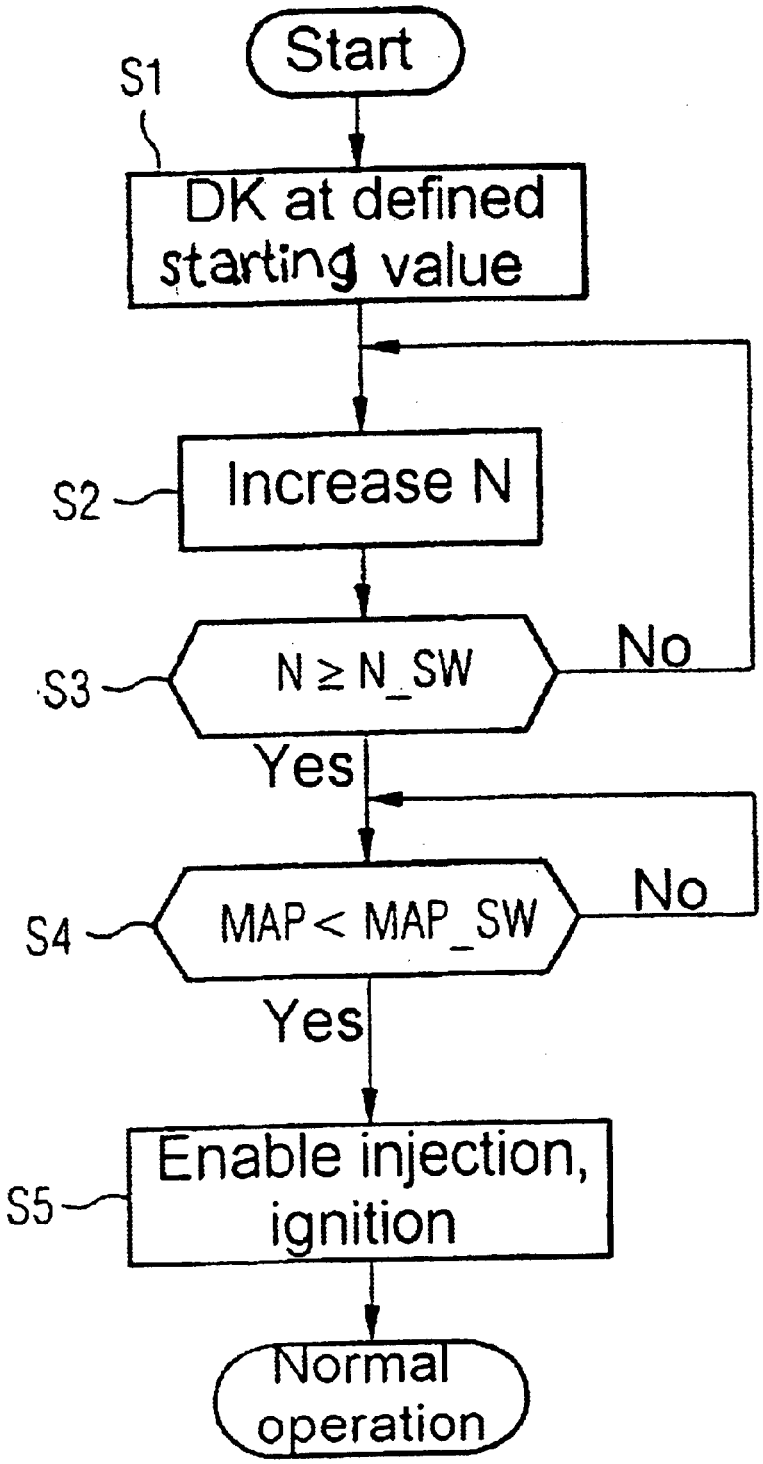
FIG. 2 shows a flowchart to illustrate the starting method for the internal combustion engine.
Figure 3:
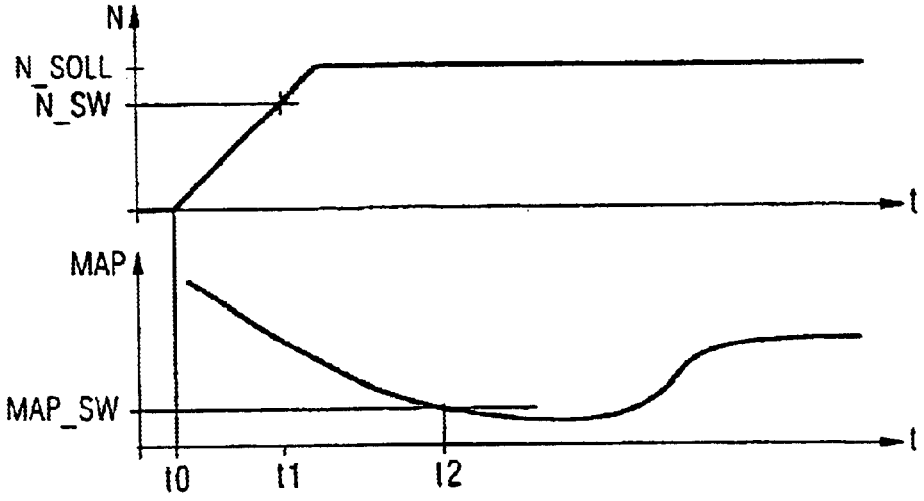
FIG. 3 shows the time profiles of selected parameters of the internal combustion engine during the starting operation.

The method for starting the internal combustion engine is explained in more detail by means of the flow chart according to FIG. 2 and the time graph according to FIG. 3.

As required by a starting operation for the internal combustion engine, in a first method step SI the throttle valve 14 is set at a defined starting value. This starting value for the throttle-valve opening angle DKW is determined experimentally by tests and is filed in the storage device 22. In a preferred embodiment, the throttle-valve opening angle DKW selected is equal to the value zero, that is to say the throttle valve 14 is closed during the starting of the internal combustion engine 10, so that the suction-pipe pressure MAP falls rapidly during the starting operation. It is also possible, however, to open the throttle valve 14 slightly during the starting operation. Instead of applying the starting value for the throttle valve directly, this starting value may also be derived via a known torque structure which is based on the torque indicated in the internal combustion engine and which comprises, as essential functional areas, the torque requirement, the torque co-ordination and the torque conversion.

Subsequently, in a method step S2, the crankshaft starter alternator 28 is switched on (time point to in FIG. 3). The rotational speed N of the internal combustion engine increases and the suction-pipe pressure MAP falls. The current rotational speed N is continuously detected by means of the rotational-speed sensor 23 and, in method step S3, is compared with a threshold value N_SW. The threshold value NSW is determined experimentally and is likewise filed in the storage device 22. A typical value for this is around 800 rev/min. In order to allow for external influences during the starting of the internal combustion engine, in particular the temperatures, the threshold value N_SW may be fixed as a function of temperature. In this case, the value TKW determined by means of the temperature sensor 25 for the coolant of the internal combustion engine is the input variable of a characteristic map KFI which is filed in the storage device 22.

If the rotational speed N is below the threshold value N_SW, there is a branch-off to method step S2 and the rotational speed is increased further. When the threshold value N_SW is reached (time point t1 in FIG. 3), a check is made as to whether the suction-pipe pressure MAP has fallen below a predetermined threshold value MAP_SW.

This interrogation is carried out in a standby loop (method step 4). During this repeated interrogation, the rotational speed is not increased any further.

The value for the instantaneous suction-pipe pressure MAP is either detected directly by means of the suction-pipe pressure sensor 27 in the manifold 26 and compared with the threshold value MAP_SW or calculated in a model-assisted manner via a known suction-pipe filling model from various parameters of the internal combustion engine, in particular using the mass airflow MAF of the air mass meter 12 and further influencing variables, as is specified, for example, in EP 0 820 559 B1.

The threshold value MAP_SW is determined experimentally by tests and is likewise filed in the storage device 22. In order to allow for external influences during the starting of the internal combustion engine 10, in particular the temperature, the threshold value MAP_SW may be fixed as a function of temperature. In this case, the value TKW determined by means of the temperature sensor 25 for the coolant of the internal combustion engine is an input variable of a characteristic map KF2 which is filed in the storage device 22.

As is clear from FIG. 3, the suction-pipe pressure MAP is still above the threshold value MAP_SW, even after the rotational-speed threshold value N_SW is reached, because the manifold 26 first has to be sucked empty by the internal combustion engine 10. When the suction-pipe pressure MAP has fallen to the threshold value MAP_SW (time point t2 in FIG. 3), fuel injection and ignition are enable step S5. There is subsequently a transition to the normal operation of the internal combustion engine. However, ignition may also be enabled even earlier.

What is claimed is:

1. A method for starting an internal combustion engine, with a crankshaft starter alternator, comprising the steps of:

setting a throttle valve arranged in the intake duct at a starting value, accelerating the internal combustion engine via the crankshaft starter alternator to a desired idling rotational speed, determining the suction-pipe pressure in the intake duct downstream of the throttle valve, and enabling fuel injection when the suction-pipe pressure undershoots a predetermined threshold value.

2. The method as claimed in claim 1, further comprising the step of enabling ignition when the suction-pipe pressure undershoots the predetermined threshold value.

3. The method as claimed in claim 1, further comprising the step of setting the throttle valve to be closed during starting of the internal combustion engine.

4. The method as claimed in claim 1, further comprising the step of detecting the suction-pipe pressure with a pressure sensors.

5. The method as claimed in claim 1, further comprising the step of calculating the suction-pipe pressure from operating parameters of the internal combustion engine.

6. The method as claimed in claim 1, further comprising the step of experimentally determining the threshold value for the suction-pipe pressure and filing the value in a storage device of a control device controlling the internal combustion engine.

7. The method as claimed in claim 6, further comprising the step of filing the threshold value in a characteristic map as a function of the temperature of the internal combustion engines.

8. The method as claimed in claim 1, further comprising the step of checking for the undershooting of the threshold value only when the rotational speed of the internal combustion engine has reached a predetermined threshold value.

9. The method as claimed in claim 1, wherein the method is used during a cold start of the internal combustion engine.

10. A starting device for an internal combustion engine, comprising:

a device which sets a throttle valve arranged in an intake duct at a starting value, a crankshaft starter alternators which accelerates the internal combustion engine to a desired idling rotational speed, a device for determining a suction-pipe pressure in the intake duct downstream of the throttle valve, and a device for enabling fuel injection when the suction-pipe pressure undershoots a predetermined threshold value.

* * * * *